United States Patent [19]

Metz et al.

[11] Patent Number: 4,632,011

[45] Date of Patent: Dec. 30, 1986

[54] AUTOMATIC LOADER FOR AN ARMORED VEHICLE HAVING A ROTATABLE TURRET

[75] Inventors: Josef Metz, Neuss; Manfred Pehker, Duesseldorf; Erich Zielinski, Haan, all of Fed. Rep. of Germany

[73] Assignee: Rheinmetall GmbH, Duesseldorf, Fed. Rep. of Germany

[21] Appl. No.: 617,677

[22] Filed: Jun. 5, 1984

[30] Foreign Application Priority Data

Jun. 3, 1983 [DE] Fed. Rep. of Germany ..... 3320241

[51] Int. Cl.[4] ..... F41F 9/10

[52] U.S. Cl. ..... 89/36.13; 89/33.4; 89/46

[58] Field of Search ..... 89/36.13, 45, 46, 47

[56] References Cited

U.S. PATENT DOCUMENTS

| | | | |
|---|---|---|---|
| 2,433,568 | 1/1976 | Krauss-Maffei . | |
| 2,499,271 | 2/1950 | Harvey et al. | 89/46 |
| 2,826,136 | 12/1979 | Thyssen . | |
| 2,837,303 | 3/1980 | Thyssen . | |
| 3,046,642 | 7/1982 | Wegmann . | |

FOREIGN PATENT DOCUMENTS

| | | | |
|---|---|---|---|
| 1578093 | 5/1971 | Fed. Rep. of Germany | 89/46 |
| 1523432 | 8/1978 | United Kingdom | 89/46 |

*Primary Examiner*—Stephen C. Bentley

[57] ABSTRACT

The invention relates to an automatic loader for an armored vehicle having a rotatable turret adapted to feed vertically stored projectiles from a storage magazine into the loading chamber of a large caliber weapon from which it can be inserted into the gun barrel by means of a rammer. The arrangement of the invention provides a rapid transporting of the vertically stored ammunition from a space saving storage position to a loaded ready to fire position.

The automatic loader of the invention includes an automatically driven endless ammunition magazine at least partially mounted within the outer elevation a of the turret and within the inner elevation region b of the vehicle trough. This magazine is separated from the personnel chamber of the armored vehicle by means of armored walls and includes a loading tray which is connected to a feeder for pivotally transporting a vertically stored projectile into a loading position from which it can be slid into the gun barrel of the weapon by means of the rammer. The loading tray functions as a partial ammunition container of the ammunition magazine as well as a feeder for the projectile. The magazine is independently rotatable with respect to the rotatable turret by means of a roller bearing.

4 Claims, 10 Drawing Figures

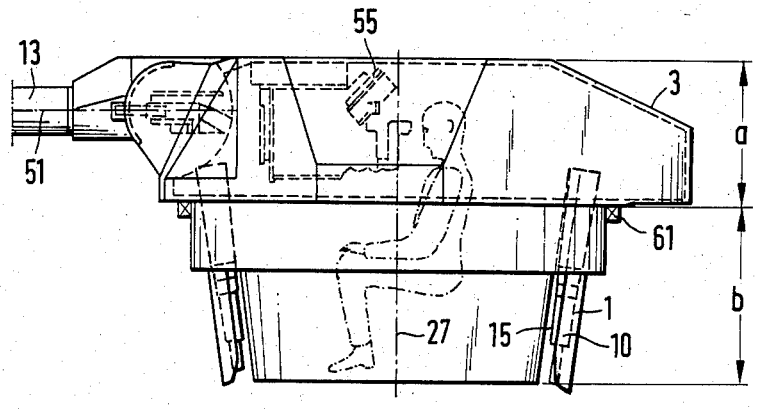
FIG.2
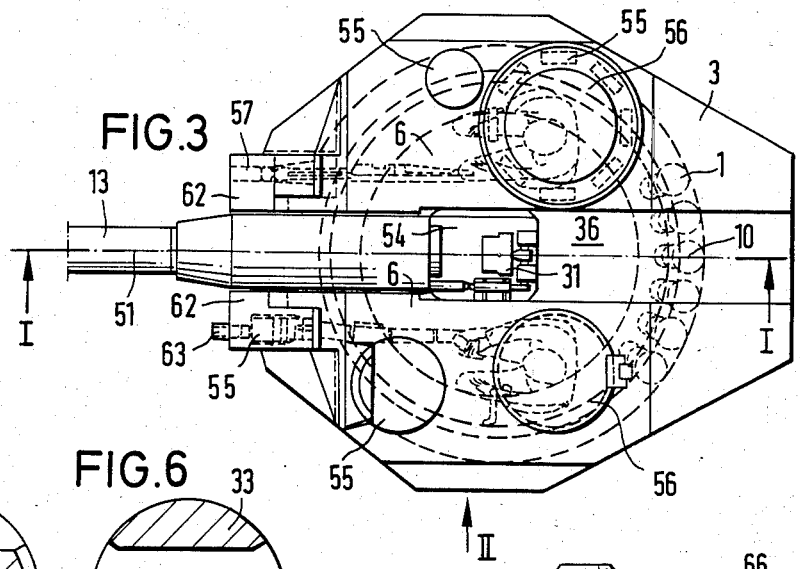
FIG.3
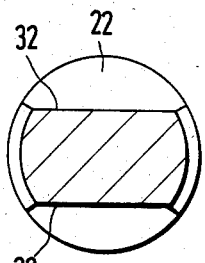
FIG.5
FIG.6
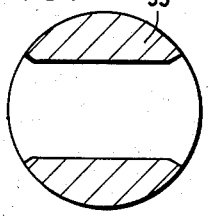
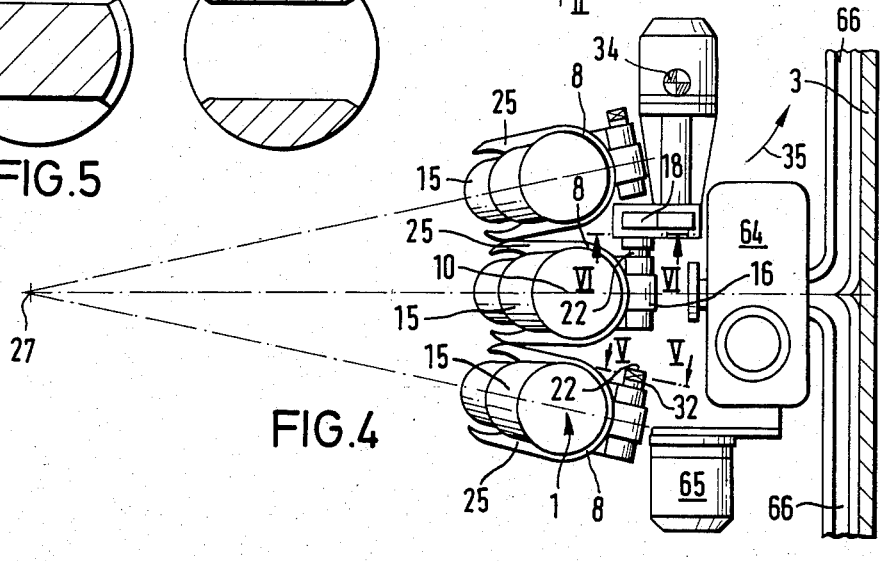
FIG.4

AUTOMATIC LOADER FOR AN ARMORED VEHICLE HAVING A ROTATABLE TURRET

BACKGROUND OF THE INVENTION

The invention pertains to an automatic loader for an armored vehicle.

Such automatic loaders are for example disclosed in German published application No. 30 17 323 and in U.S. Pat. No. 4,391,179. In this known automatic loader for a large caliber weapon a rammer or device for driving a projectile into the breech of the gun barrel is required which projectiles are moved into a sliding-in position in the turret of the vehicle. These projectiles are arranged in a turret-fixed magazine in a vertical stack and must then be turned one after the other and transported by a plural transporting arrangement towards the gun barrel. The projectiles are first, after leaving the magazine transported in a vertical direction, then rotated in a rotating arrangement and before they are placed on a lifting arrangement for vertical transporting and then must be laterally slid in a sliding arrangement. Such automatic loaders require for the various transport arrangements a high mechanical and constructional input which causes the drawback of frequent malfunctioning and requires a large space. Such transport arrangements are heavy which negatively influences the armor for the vehicle, respectively the weight of the armored vehicle, and require for the travel of the projectile via the numerous transport stations an inordinately large transportation time.

SUMMARY OF THE INVENTION

It is an object of this invention to provide an automatic loader of the afore-described type which achieves with a simpler construction and less dead weight a rapid fire readiness for vertically stacked ammunition and which automatic loader transports this ammunition quickly and in a space-saving manner from a secure storage position into a firing position.

The automatic loader of this invention has the decisive advantage that vertically stacked projectiles are transported into a fire-ready position by means of a feed arrangement which moves exclusively swingable. By virtue of the fact that the novel construction of the automatic loader is space-saving and light, it is particularly suitable for coaction with a large caliber high output cannon mounted on a wheeled armored cannon.

In view of the reduced space requirement of the automatic loader of this invention there is achieved a particularly small and low turret silhouette, within which, dependent on the automatic flow of ammunition, a reduced manning of the turret by only two persons is achieved, who may operate the weapon while being seated one behind the other or one next to the other in one or more rooms which are in communication with each other and which are separated from the ammunition magazine by armored walls. When comparing this novel construction with that of German published application No. DE-OS 30 17 323 one can note that the seating arrangement of the novel arrangement of the invention makes for a relatively shorter turret silhouette because with the known turret the driver of the armored vehicle must be disposed behind the space for the recoiling gun barrel.

By means of the automatically driven endless magazine in accordance with this invention which extends into the exteriorly visible turret region, there is also obtained the further advantage of a directly swinging-in of the projectile into the load-ready position, whereby in a particularly advantageous manner a loading tray, acting as a magazine holder, transports the projectile directly into the load-ready position.

BRIEF DESCRIPTION OF THE DRAWINGS

With these and other objects in view, which will become apparent in the following detailed description, the present invention, which is shown by example only, will be clearly understood in connection with the accompanying drawings, in which:

FIG. 2 is a side-elevational view in the direction of the arrow II in FIG. 3 which illustrates the armored turret together with the seating arrangement for the personnel manning the turret;

FIG. 3 is a plan view of the first embodiment of an armored turret having the carousel-like arranged magazine and a seating arrangement at both sides of the gun barrel for the personnel manning the turret;

FIG. 4 is a cross-sectional view along plane IV—IV of FIG. 1 which illustrates in plan view the directly upwardly pivotable automatic loading mechanism;

FIG. 5 is a cross-sectional view along plane V—V of FIG. 4 which is a cross-sectional view of a shaft portion of the automatic loading mechanism;

FIG. 6 is a cross-sectional view along plane VI—VI in FIG. 4 which illustrates in cross section a detachable driving claw;

DETAILED DESCRIPTION

Figure 1:
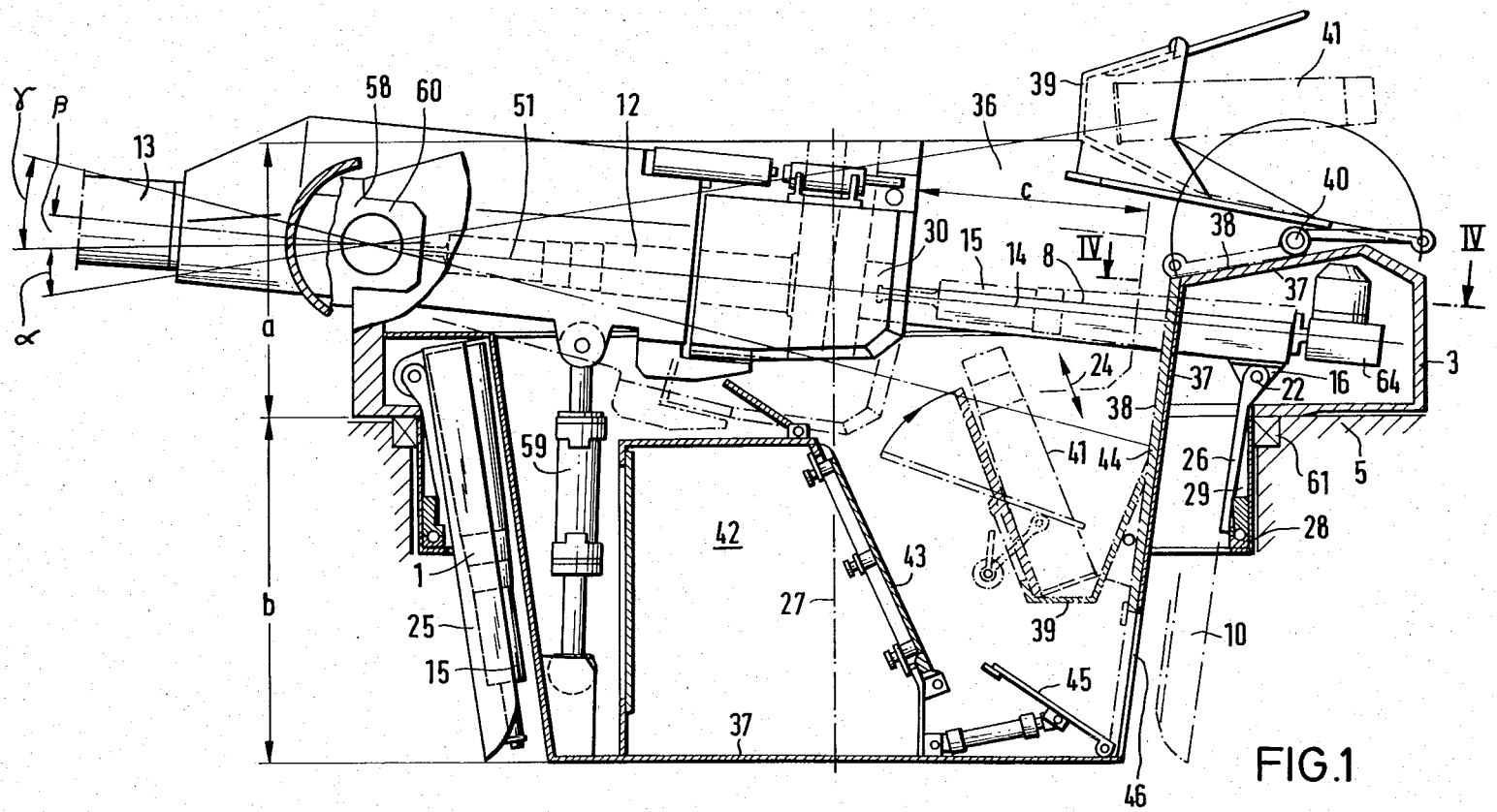
FIG. 1 is a cross-sectional view along the plane I—I of FIG. 3 which plane passes through the axis a carousel-like magazine combined with an automatic loader within a rotatable armored turret.

FIGS. 1 to 3 illustrate a first embodiment of a turret 3 which is rotatably mounted in the vehicle trough 5. An automatic loader includes in combination a magazine 1 and feed arrangement 16 for a gun barrel 13. The gun barrel 13 is operatively arranged in the middle of a weapon shaft 36 accessible to the exterior at the armored turret 3 and is supported by a known turret-fixed cradle support 58 and a known elevation adjustment cylinder 59. The weapon shaft 36 avoids that the gun barrel 13 influences (increases) the outer turret height because, during a swinging movement of the recoiling gun barrel 13, the gun barrel 13 may exit from the turret-contour. The gun barrel 13 is adapted to swing about the trunnion 60 of the cradle support 58 mounted on the bottom member 54 about an angle alpha. A personnel chamber 6 is divided into two halves by the weapon shaft 36 and these two halves of the chamber are in communication with each other via a communication tunnel 42, disposed underneath the weapon shaft 36, for purposes of direct contact between the commander and the gunner of the armored vehicle. The turret 3 is concentrically mounted in the turret trough 5 in a known manner for purposes of centering the turret 3 in the region b and simultaneously supporting the turret 3 in the outer region a. The turret 3 is rotatable about the middle axis 27 by means of a non-illustrated drive.

The turret 3 is equipped with an observation and aiming arrangement 55 within the elevation adjustment range an inlet and an escape hatch 56, as well as a shielded machine gun 57, as well as a further non-illustrated machine gun, the function of which is not relevant to the invention and therefore is not further described in detail. Separate fold-down shields 62 at the turret mouth region make possible the mounting of machine guns on both sides of the gun barrel 13, while obtaining a circumferential protection for the bearing support of the trunnion 60, the arrangement of the shielded machine gun 57 and an auxiliary aiming barrel 63 for the gunner which is mechanically coupled to the gun barrel.

The gun barrel 13, which is elevationally adjustable about the angular range $(\alpha+\gamma)$ about the cradle support 58 assumes an index position 14 corresponding to an elevation angle $\beta$ which is necessary for the loading procedure. In this position 14 the load chamber 12 of the gun barrel 13, after release of the wedge breech block 31, so that a new projectile 15 can be slid in, is placed in readiness by means of a rammer 64 which constitutes an extension of the gun barrel 13 along the gun barrel axis 51. The rammer 64 is illustrated as a chain rammer in FIG. 4 and is mounted within the elevational region a which is mounted by non-illustrated mounting elements on the turret 3. The projectile 15 rests in the loading position 14 on a loading tray 8 of the feed arrangement 16.

The feed arrangement 16 is pivotally mounted in the elevational range a of the turret 3 about a shaft 22, whereby the shaft 22 is mounted horizontally in a shaft support 26 of a support member 28 secured to the turret 3. The support member 28 consists essentially of two ring-like support halves, whereby one support half is joined in the region of the turret support bearing 61 to the turret 3 in the elevation region b. There extends from one half a holding element 29, shaped in the form of a pipe and joined to the turret 3, and on the periphery of the other support half, arranged one next to the other, the shaft supports 26 of the feed arrangement 16 are fixedly mounted. Via a non-illustrated rotational drive of the support member 28 the ammunition holders 25, forming the feed arrangement 16, in which the projectiles 15 are suspended, are rotatable carousel-like about the middle vertical axis 27, whereby the so-constructed magazine 1 can assume a projectile receiving position 10 independently from the rotational movement of the turret 3. In the projectile receiving position 10 the projectile 15 is by means of the ammunition holder 25, which is formed by the load tray and the feed arrangement 16, swingable from below upwardly by means of a not further described drive 18 (FIG. 4) directly into the load-ready position 14 which extends into the region 30 of the wedge breech 31.

Within the armored turret 3 and the inner region b of the vehicle trough 5 there is in a limited sense defined the divided personnel chamber 6 relative to the magazine 1 by means of an armored wall 37 which protects it from virtually all dangers coming from the outside, whereby in particular the personnel manning the turret are protected when there is an ammunition fire and when ammunition is exploding. In the region 38 of the protective wall 37 where it surrounds the rammer 64 and the drive 18 (FIG. 4) there is arranged an articulated drive 40 of a cartridge extractor 39 which is upwardly swingable and slidably inwardly arranged in the weapon shaft 36. When the gun barrel recoils over a path c the cartridge casings 41 drop into the cartridge chamber 39 situated near the bottom of the weapon shaft 36, which cartridge chamber 39 is swung upwardly by means of the drive 40 for purposes of expelling the empty cartridges 41 in the rear region of the turret 3. After termination of the loading process the cartridge holder 39 moves again into the starting position, whereby the rear wall 44 of the cartridge holder 39 and a pivotable flap 45 closes the opening of a magazine hatch 46, via which when the cartridge holder 39 and flap 45 are swung away the feed arrangement 16 for loading a new projectile 15 is swung in the directions 24.

The communications tunnel 42 of the personnel chamber 6, which serves for direct contact between the gunner and the commander of the armored vehicle, is provided with an armor protected emergency exit in the form an escape hatch having a removable armor plate 43 which is mounted over the weapon shaft 36.

FIG. 4 illustrates the drive 18 for the feed arrangement 16, the rammer 64 and the drive 65 for the cartridge holder 39 (FIG. 1) in the projectile-extracting position 10 of the magazine 1. The drive 18, which is swingable about a shaft 34 that is arranged vertically and is turret-fixed, forms a form-locking connection with a unilaterally projecting member 32 of the shaft 22, whereby the loading tray 8 having a projectile 15 is transposed into the load-ready position 14 (FIG. 1) by being swung upwardly and is return-swingable into the extracting position 10. The profile of the member 32 can be flat on two opposite sides as is illustrated in FIG. 5, whereby a claw 33 of the drive 18 as illustrated in FIG. 6 is slidable over this flat portion as it has a central slit. Drive 18 assumes, during the circular-shaped further transporting of the ammunition holder 25 about the middle axis 27 of the magazine 1, a position which is swung outwardly in the direction 35 from the form-locking connection with the member 32. In the load-ready position 14 (FIG. 1) the projectile 15 is transported by the rammer 64, formed as a chain-rammer, into the loading chamber 12 (FIG. 1). The chains of the chain-rammer are, in the retracted position, received by the chain guides 66.

Figure 7:
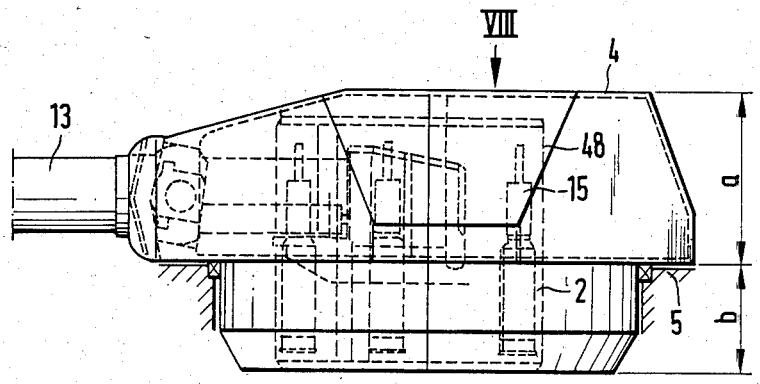
FIG. 7 is a side-elevational view in the direction of the arrow VII in FIG. 8 which illustrates a second embodiment of the armored turret of the armored vehicle including a magazine for uprightly stored ammunition.
Figure 10:
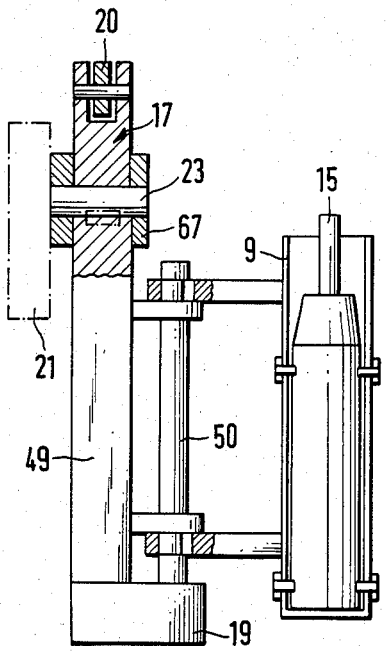
FIG. 10 is a partial cross-sectional view in the direction of the arrow X in FIG. 8 which illustrates the feed arrangement which is swingable in two planes.
Figure 8:
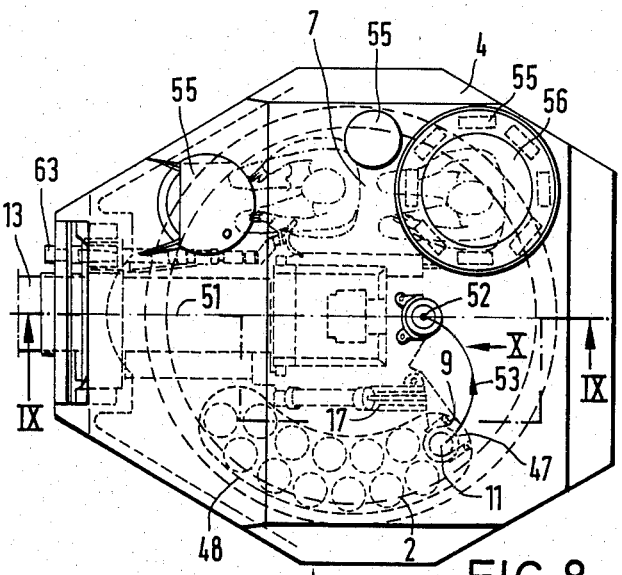
FIG. 8 is a plan view of the turret of FIG. 7 illustrating the arrangement of a band magazine disposed at one side of a gun barrel and a chamber for the personnel manning the weapon disposed at the other side of the gun barrel as well as the ammunition magazine and an upwardly swingable feed arrangement relative thereto.
Figure 9:
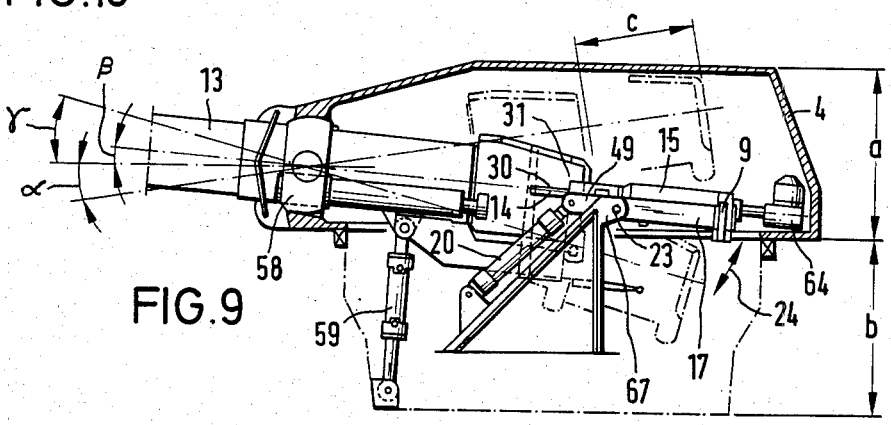
FIG. 9 is a cross-sectional view along plane IX—IX in FIG. 8 which illustrates the feed arrangement in a load-ready position.

A further embodiment of an automatic loader being equipped with an endless and vertically arranged magazine 2 and a feed arrangement 17, is rotatably arranged within a turret 4, which is rotatable in the vehicle trough 5 of a gun barrel 13. This embodiment is illustrated in FIGS. 7 to 9. Within an enclosed armored turret 4 the gun barrel 13 is elevationally adjustable about the angular range $(\alpha+\gamma)$ about the trunnion 58 by means of the elevation adjusting cylinder 59, whereby the index position 14 required for the loading process, as has been explained in conjunction with the embodiment of FIG. 1, is assumable at an elevation angle $\beta$. The turret is constructed in such a way that the gun barrel which recoils over a distance c does not, in an inclined position within the angular range $\alpha$, contact the roof of the turret. The armored turret 4 also contains the afore-described observation and aiming arrangements 55 and 63 as were described in conjunction with FIG. 3, as well as an escape hatch 56, only with the difference that all of these arrangements are disposed at one side of the gun barrel 13. The personnel manning the turret consists of the armored vehicle commander and gunner which are both seated at one side, one behind the other in the personnel chamber 7. On the side of the turret which is opposite to that reserved for the personnel manning the turret, within the outer (upper) turret region a and the inner (lower) turret region b of the vehicle trough 5, there is arranged a bank magazine 2 consisting of two parallel adjoining circular-shaped paths. The projectiles 15 which are vertically mounted in the band magazine 2 are surrounded by a magazine housing. This magazine housing affords, as a housing made of synthetic material and having a protective wall 48, a substantial protection relative to the burning ammunition with respect to the personnel chamber 7. At the rear turning point 47 of the magazine housing there is arranged an extraction position 11 from which the projectile 15 is transported exclusively swingably movably from a loading tray 9 connected to the feed arrangement 17 via an intermediate position 52 from below into the region 30 of the wedge breech block 31 into a loading position 14 extending therein. The projectiles 15 are further transported within the band magazine 2 by a non-illustrated drive and are swung from the extracting position 11 in the direction 53 and thereafter in the direction 24 by means of the drive 20, 21, and 19 illustrated in FIG. 10. Thereby the automatic swing movement of the projectile 15 which moves in the vertical direction 24, and which is maintained in a loading tray 9 connected to the swing lever 49 of the feed arrangement 17, by means of the rotational movement of the swing lever 49 about a horizontal shaft 23 mounted in the elevational region a of the armored turret 4 either by means of a straight pull drive 20 connected to the swing lever 49 or by means of a rotational drive 21 (FIG. 10) connected to the shaft 23 in the direction 24. The shaft 23 is mounted in a turret-fixed bearing support 67, which advantageously for carrying out the necessary swing movements is laterally arranged next to the gun barrel 13 between the band magazine 2 and the wedge breech block 31. The bearing support 67 can thereby receive either a hydraulic piston cylinder unit as a straight pull drive 20 or in a non-illustrated mounting the drive 21 (FIG. 10). When the loading position 14 is assumed by the projectile 15 it is transportable by means of the afore-described turret-fixed rammer 64 into the loading chamber 12 (FIG. 1).

In FIG. 10 the feed arrangement 17, pivotable about the shaft 23, is illustrated with a loading tray 9 which is pivotable about the swing lever 49 of the feed arrangement 17, whereby the projectile 15 is swingable in two normal relative to each other planes from the extraction position 11 (FIG. 8) into the sliding-in position 14 (FIG. 9). The swing lever 49 is thereby directly vertically swingable via the shaft 23 joined to the rotational drive 21 or a rotational movement about the shaft 23 which is initiated by the drive 20. The drive 19 and driven shaft 50 connected thereto are joined with the swing lever 49, to which there is connected in a form-locking manner the load tray 9. Thereby it is possible that the load tray 9 is swingable for assuming the intermediate position 52 by the drive 19 from the extraction position 11 (FIG. 8) laterally about the shaft 50, and the loading tray is thereafter upwardly swingable from the intermediate position 52 to the adjoining load-ready position 14 (FIG. 9).

The drives for the aiming arrangement for the gun barrel 13 and the armor turret 3, 4 as well as the drives for the automatic loader are preferably equipped with hydraulic drive mechanisms. It has been found to be particularly advantageous, when a high output is required, to use small space-saving constructional groups (cylinder, motor). For avoiding eventual danger of fire, there can be used as a transfer medium a non-combustible liquid.

The arrangement of combining an ammunition magazine in which the projectiles are vertically stored deep in the vehicle trough renders a number of advantages which are as follows: The automatic loader is disposed in a space-saving manner and includes a feed arrangement which results in addition to a reduced impact probability by projectiles on the armored vehicle also in an improved protection for the personnel manning the armored vehicle, provides a small turret silhouette, which is constructed particularly short and flat, and provides for a rapid automatic transport possibility of the projectiles from the magazine into a load-ready position for a large caliber gun barrel mounted on the armored vehicle.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. In an armored vehicle an improved automatic loader for transporting projectiles, said vehicle having a rotatable turret which has an upper most region visible from the outside, said projectiles being vertically stored in said vehicle and being movable in an endless circular band automatic magazine which is coaxial with respect to said turret and extends into said uppermost region to a position in the loading chamber of a large caliber weapon from which the projectile is slid into the gun barrel of the weapon by means of a rammer, the improvement comprising (a) said endless band magazine is operatively mounted in said uppermost region in a trough of the armored vehicle which is disposed immediately below said uppermost region of the rotatable turret, said armored vehicle also includes a personnel chamber which is separated from said uppermost region and trough of said armored vehicle;

(b) a plurality of projectiles being stored in said magazine in a first vertical position, feeding means being operatively mounted in said armored vehicle to successively grasp projectiles stored in said magazine in said first position and transport them by means of a pivotal movement into a second loading position in said loading chamber;

said feeding means are pivotally mounted in said armored vehicle about a first horizontal shaft, and first driving means operatively connected to said feeding means for pivoting them about said first horizontal shaft;

(c) loading tray means operatively mounted in said armored vehicle, said feeding means operatively engaging said loading tray means which function also as partial ammunition containers for said magazine;

(d) a ring support is rotatably mounted in said armored vehicle, said loading tray means being operatively mounted on said ring support, the ring support is coaxial with respect to the turret axis and independently rotatable with respect thereto;

(e) said loading tray means are mounted equidistantly from each other along the circumferential periphery of said ring support; and (f) said loading tray means are movable by said first driving means via said feeding means by being pivoted inwardly and upwardly toward the turret and ring support axis about a second support shaft from said first stored position directly into said second loading position.

2. The improvement in an automatic loader in an armored motor vehicle as set forth in claim 1, wherein said load tray means are mounted on said support ring support and are operatively connected to said feeding means via said second support shaft in said first portion of said armored vehicle; said load tray means extending into and said support ring being mounted in said second portion of said armored vehicle, said load tray means and projectiles mounted therein being pivotally movable by said feeding means into alignment with the longitudinal axis of the gun barrel.

3. The improvement in an automatic loader in an armored motor vehicle as set forth in claim 2, wherein (a) said second support shaft and feeding means engaging each other by means of a flattened portion and claw;

(b) said flattened portion and claw forming a detachable connection;

(c) said feeding means being pivotally movably mounted in said armored vehicle about a vertical axis so that flattened portion and claw connection selectively engage and disengage each other.

4. The improvement in an automatic loader in an armored motor vehicle as set forth in claim 3, wherein (a) said turret is provided at its rear with a weapon shaft in the region of said loading chamber for the projectiles, said gun barrel recoiling over a predetermined path along said weapon shaft;

(b) said weapon shaft dividing said personnel chamber into two equal laterally limited partial personnel chambers;

(c) said two partial personnel chambers are defined by armored protective wall means which also define a communication channel between said two partial chambers which extends underneath said weapon shaft;

(d) empty cartridge expelling means are operatively mounted in said armored vehicle underneath said weapon shaft to be inserted into said weapon shaft by means of a linkage and to expel empty cartridges from said turret; and (e) the rear wall of said empty cartridge expelling means include a hatchway and a cover which is pivotally mounted in said armored vehicle to selectively cover said hatchway so that when said empty cartridge expelling means is swung upwardly by said linkage said feeding means is thereafter swung upwardly to transport a projectile into said loading chamber.

* * * * *